US006361185B1

(12) United States Patent
Won et al.

(10) Patent No.: US 6,361,185 B1
(45) Date of Patent: Mar. 26, 2002

(54) SAFETY STRUCTURE TO PREVENT A SOCKET FROM BEING OVER-HEATED IN A LAMP STRING

(76) Inventors: Jen-Chen Won; Fu-Nan Chen, both of P.O. Box 96-405, Taipei 106 (TW)

( * ) Notice: Subject to any disclaimer, the term of this patent is extended or adjusted under 35 U.S.C. 154(b) by 0 days.

(21) Appl. No.: 09/615,255

(22) Filed: Jul. 12, 2000

(51) Int. Cl.[7] ..... F21V 21/14; A47G 33/16; H01H 85/54

(52) U.S. Cl. ..... 362/227; 362/249; 315/185 S; 315/185 R; 315/59; 315/210; 337/292

(58) Field of Search ..... 362/249, 252, 362/123, 806, 227; 315/185 S, 59, 185 R, 210, 58; 337/290, 292, 293

(56) References Cited

U.S. PATENT DOCUMENTS 4,030,059 A * 6/1977 Tong ..... 337/262
4,223,248 A * 9/1980 Tong ..... 315/185 S
4,227,228 A * 10/1980 Cheng ..... 315/185 S
4,500,811 A * 2/1985 McMillan ..... 315/58
4,812,956 A * 3/1989 Chen ..... 362/249
5,971,807 A * 10/1999 Lin ..... 439/646
6,163,113 A * 12/2000 Fu ..... 315/185 S

* cited by examiner

*Primary Examiner*—Thomas M. Sember
(74) *Attorney, Agent, or Firm*—Troxell Law Office PLLC

(57) ABSTRACT

A safety structure to prevent a socket from being over-heated in a lamp string, which comprises a separate lamp string made of a pre-determined number of sockets connected in series. The power-supply wire of the lamp string is connected in series with an additional socket to be plugged with a protective bulb. Two copper wires mounted in the glass tube of the protective bulb are fixed in place by means of a positioning bead. The tail ends of the two copper wires are connected with a fuse having a pre-determined power dissipation. In case of the fuse in the protective bulb being over-loaded, the fuse will be burned out automatically so as to prevent the sockets from being over heated to cause a hazard.

1 Claim, 4 Drawing Sheets

SAFETY STRUCTURE TO PREVENT A SOCKET FROM BEING OVER-HEATED IN A LAMP STRING

BACKGROUND OF THE INVENTION

1. Field of the Invention

This invention relates to a Christmas lamp string, and particularly to a safety structure to prevent a socket from being over-heated in a lamp string.

2. Description of the Prior Art

The conventional Christmas lamp string is usually made of an elongate lamp string, which includes a plurality of separate lamp strings connected together; each separate lamp string includes a plurality of short power-supply wires connected between two sockets. The first bulb of the lamp string is connected, by using a longer wire, with the plug; the longer wire is twisted with the lamp string to form into a separate lamp string.

Each of the sockets in the lamp string is to be plugged with a connector, which is mounted with a bulb so as to facilitate the bulb to be replaced in case of being burned out. The number of sockets and the coefficient of resistance of each bulb are all pre-designed in accordance with the voltage and current of a given area.

The plug of each lamp string is furnished with a fuse to prevent the power-supply wire of the lamp string from being over-loaded. In case of the power-supply wire having a short circuit or being over-loaded, the fuse in the plug will be burned out automatically so as to avoid a hazard; however, the fuse furnished in the plug is not designed to prevent the socket from being overloaded.

The bulb plugged in the socket of each lamp string has two copper wires to be fixed in place with a positioning bead; the tail ends of the copper wires are mounted with a tungsten filament; the aforesaid parts are then mounted in a glass tube, of which both ends are to be sealed by means of different welding methods respectively so as to form into a bulb; the bulb is to be plugged in the socket of the lamp string. Since the sockets of the lamp string are connected one another in series, the whole lamp string is subject to having an open circuit and outage in the event of a tungsten filament being burned out.

In order to avoid the lamp string to turn off upon the tungsten filament of a bulb being burned out, an aluminum fuse of 0.065 m/m is wound around the two copper wires near the positioning bead; the number of turns of the fuse is designed in accordance with technical requirement, but it has at least 2.5 turns to enable the fuse to mount in place. The object of furnishing such a fuse is to maintain the whole lamp string to be in lighting-up condition in case of the tungsten filament being burned out; in that case, the fuse having lower resistance can still have the two copper wires maintained in conduction condition. The requirement of at least 2.5 turns of the aluminum fuse is to prevent the fuse from being burned out upon the current being not over a given value.

The aluminum fuse mounted between the two copper wires and near the positioning bead must have a resistance less than that of the tungsten; in case of the tungsten filament being burned out, the aluminum fuse can still maintain a current to flow through the two copper wires so as to avoid the lamp string to have an outage for a short time; however, since every bulb in the lamp string will lose at least a portion of the tungsten filament to share the power dissipation, the tungsten filaments of the rest bulbs will have a higher power dissipation; in other words, the serviceable life of the tungsten filament in the bulb will be reduced proportionally. Whenever the number of bulbs in a lamp string is reduced gradually, the bulb number of bulbs, which are not lit up, will be increased. Since the power dissipation of every bulb is increased, the temperature thereof will also be increased; then, the temperature of the connector of each bulb will be increased to an over-loaded condition. Generally, the material used for making the connector and the socket will be improved to withstand a given high temperature; in that case, the cost for the material thereof will be increased without solving the problem of a single bulb in a lamp string to suffer from a high temperature.

SUMMARY OF THE INVENTION

The prime object of the present invention is to provide a lamp string, in which a plurality of sockets are connected in series; the first socket and the last socket are connected with the plug by means of separate power-supply wires respectively; a socket for a protective bulb is connected in series between the first socket and the plug; the tail ends of the two copper wires of the protective bulb are mounted with a fuse; in case of the tungsten filament of a bulb in the lamp string being burned out, the tungsten filaments of the rest bulbs will be overloaded with power than the value pre-designed; then, the fuse in the protective bulb will be burned out soon to cause an open circuit so as to prevent the tungsten filaments of the bulbs from being over-loaded to cause a high temperature.

Another object of the present invention is to provide a safety structure, in which a protective bulb is plugged in the socket of the lamp string; the tail ends of the copper wires in the protective bulb are mounted with a fuse, which can be mounted in place directly by means of an assembling machine without requiring additional machine for the protective bulb.

Still another object of the present invention is to provide a safety structure, in which the protective bulb plugged in the lamp string may be designed into a shape to be the same as that of the ornamental bulb, or a cylindrical shape so as to facilitate to identify it.

A further object of the present invention is to provide a safety structure, in which the protective bulb can be plugged into a connector as that of an ornamental bulb, and then the connector can be plugged into the first socket of the lamp string.

DETAILED DESCRIPTION OF THE PREFERRED EMBODIMENT

Figure 1:
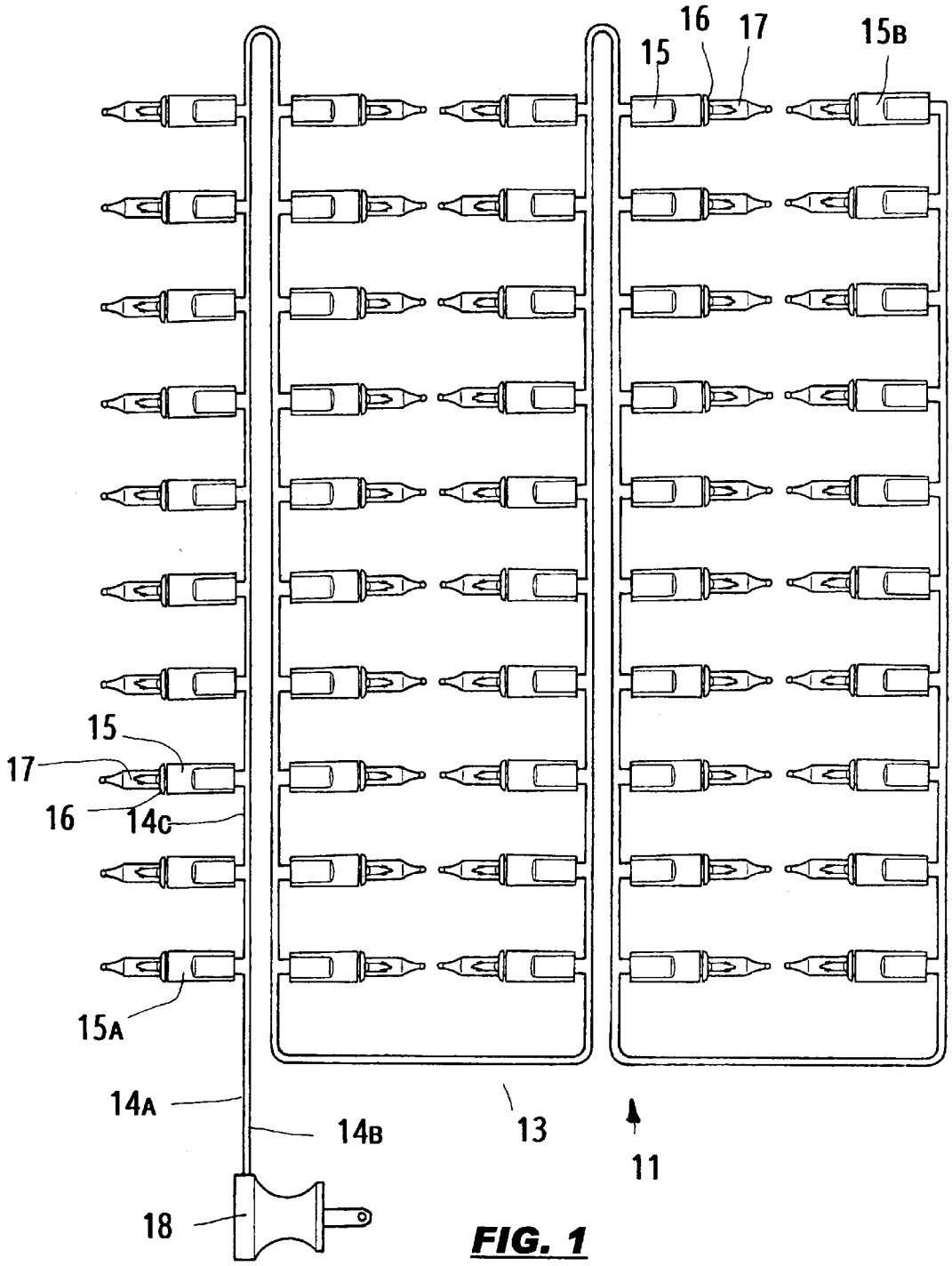
FIG. 1 Prior Art
FIG. 1 is a plan view of a conventional lamp string connected in series.
Figure 2:
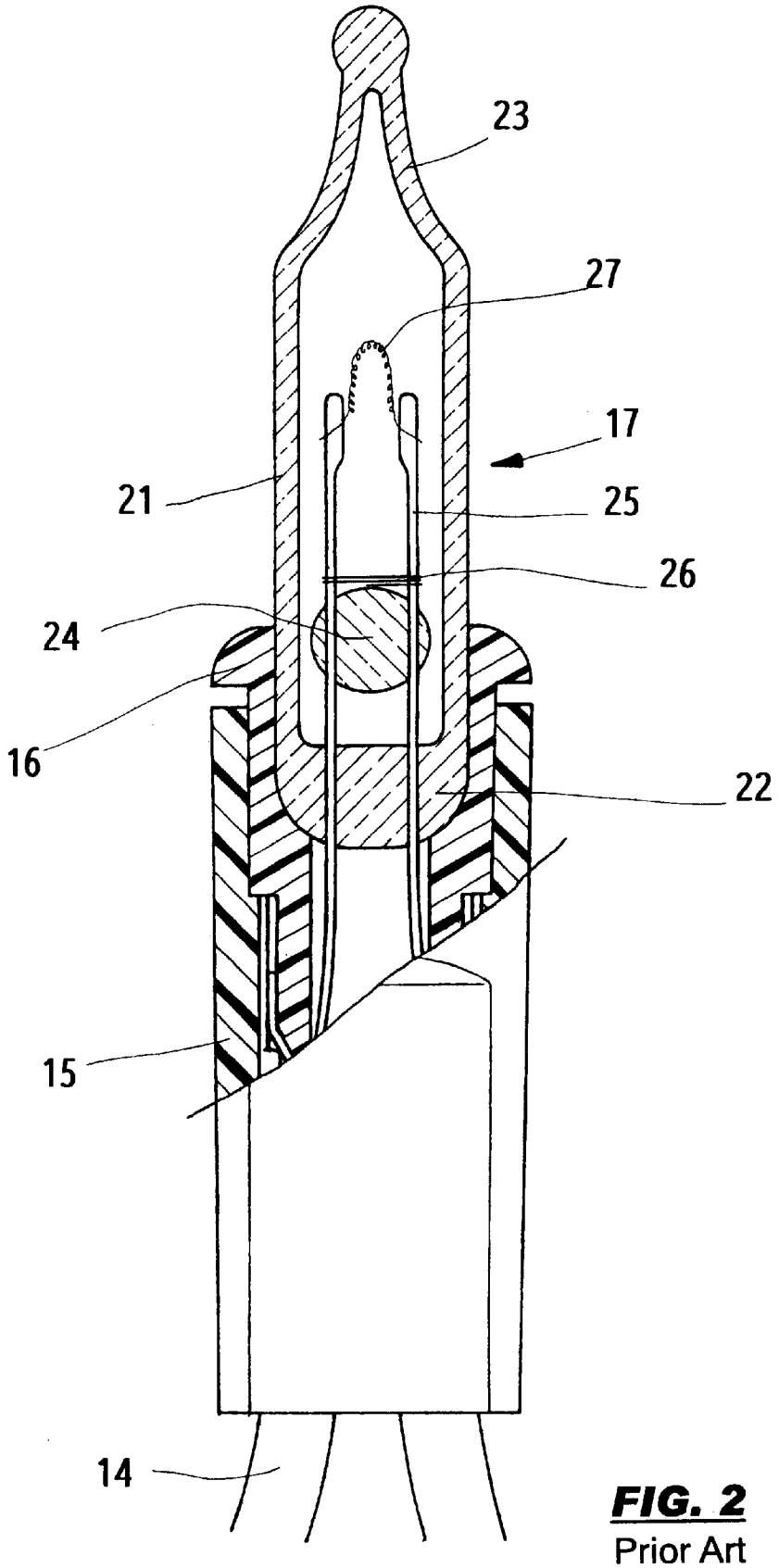
FIG. 2 Prior Art
FIG. 2 is a sectional view of a bulb of the ornamental lamp.

Referring to FIGS. 1 and 2, every separate lamp string 13 is made of a plurality of short power-supply wires 14C to connect with a plurality of sockets 15 in series, i.e., the first socket 15A is connected with a power-supply wire 14A to the plug 18, and the last socket 15B is connected with the plug 18 through a power-supply wire 14B; then, the two power-supply wires (14A+14C, 14B) are twisted together to form into one lamp string 13. All the sockets 15 of the lamp string 13 are plugged with bulbs 17 respectively via connectors 16 so as to form into a lamp string 13.

The bulb 17 in the lamp string 13 is substantially a bulb used in a conventional lamp string 13 of the ornamental lamp 11. The tail ends of the two copper wires 25 are fixed in place with a positioning bead 24 before mounting a tungsten filament 27. Beside and near he positioning bead 24, at least 2.5 turns of fuse 26 made of aluminum with a diameter of 0.065 m/m are wound around the two copper wires 25. The tail ends of the two copper wires 25 are connected with a tungsten filament 27 having a given resistance; then, the two copper wires 25 fixed in place with the positioning bead 24 are mounted in a glass tube 21 and the two copper wires 25 are connected and sealed together by means of a welding method to form into a round sealed part 22; the other end of the glass tube 21 is also sealed with the same welding method to form into a tapered sealed port 23.

The bulb 17 including two copper wires 25, a fuse 26 made of aluminum and a tungsten filament 27 is plugged into a socket 15 of the lamp string 13.

In case of the tungsten filament 27 of one bulb 17 in the lamp string 13 being burned out, the current can also flow through the aluminum fuse 26 wound around the two copper wires 25. Since the coefficient of resistance of the tungsten filament 27 of a bulb 17 in the separate lamp string 13 has been designed regularly, the resistance of the separate lamp string 13 will be reduced upon the tungsten filament 27 of a bulb 17 being burned out; then, the power dissipation of every bulb 17 will be increased to result a higher temperature therein. In case of the tungsten filaments 27 of several bulbs 17 in a lamp string 13 being burned out, the rest bulbs 17 can continue to be lit up; however, the power dissipation of each bulb 17 will be increased to a temperature which would cause the connector 16 to be unable to withstand the high temperature; in that case, a danger might take place.

Figure 3:
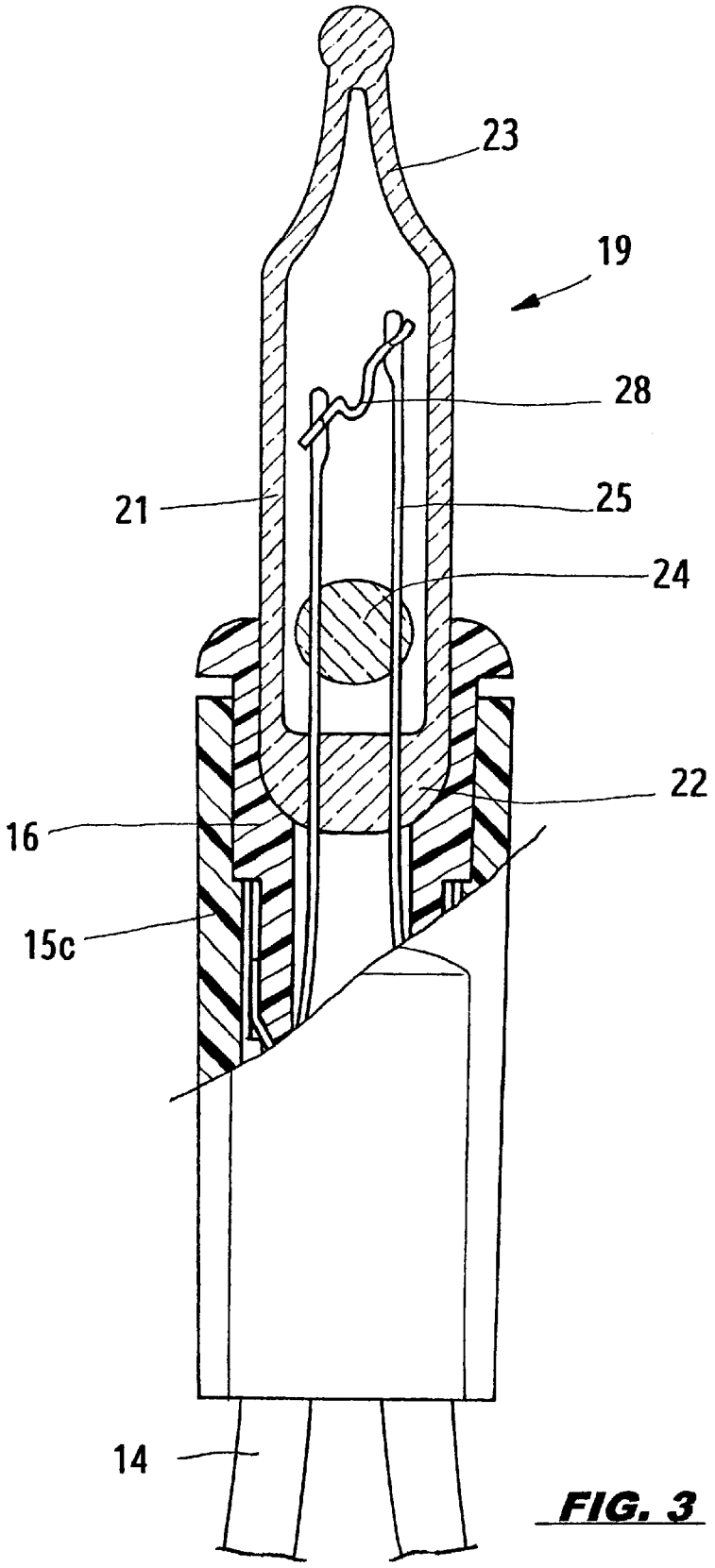
FIG. 3 is a sectional view of a bulb with a fuse according to the present invention.
Figure 4:
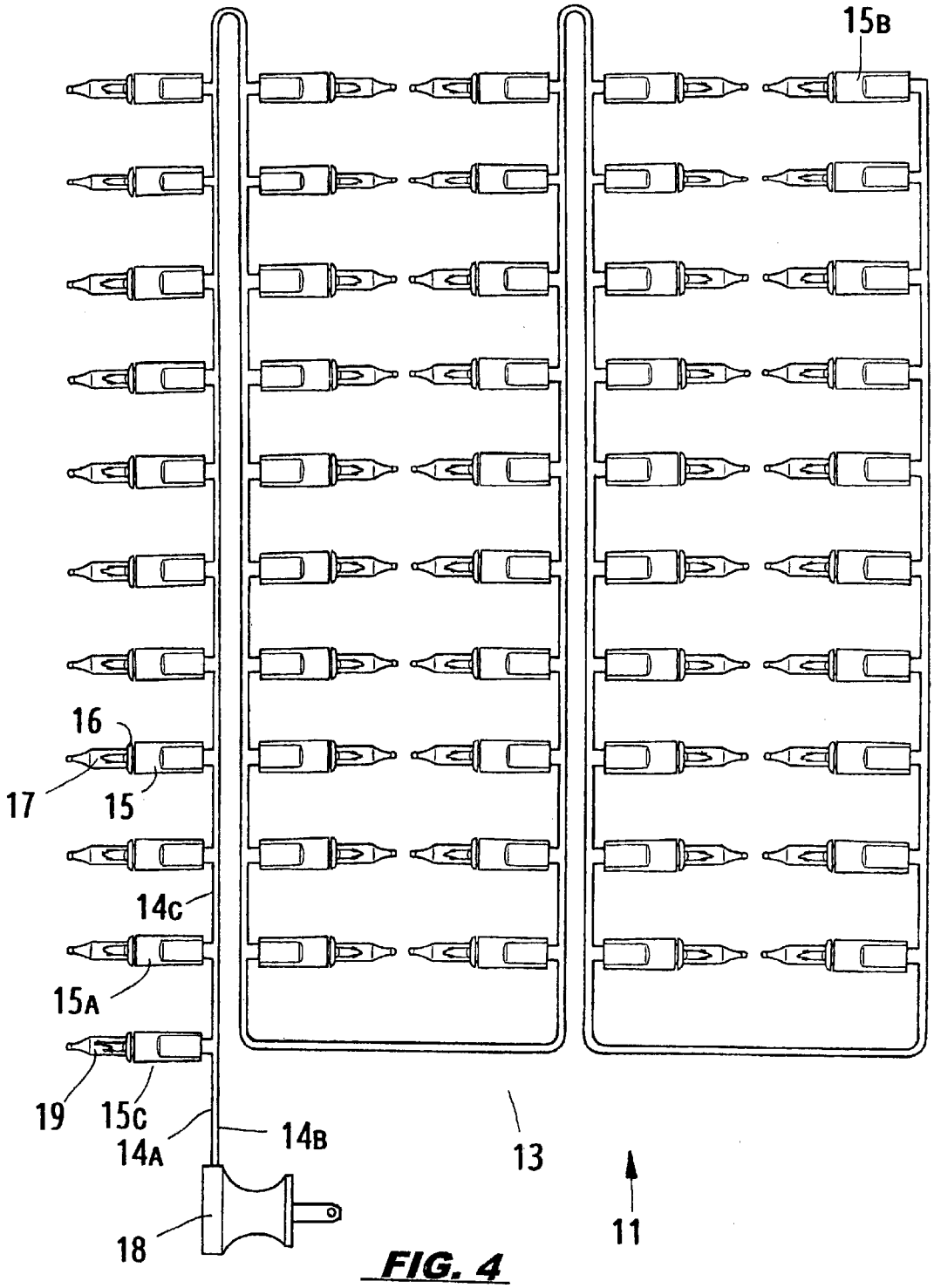
FIG. 4 is a plan view of the present invention, showing a plurality of bulbs with fuses connected in series.

As shown in FIGS. 3 and 4, the power-supply wire of the lamp string 13 is connected in series with an additional socket 15C, in which a protective bulb 19 is mounted; the protective bulb 19 is substantially a bulb 17 of the conventional ornamental lamp 11 except for the tail ends of the two copper wires 25 being mounted with a fuse 28 instead of a tungsten filament 27. In the protective bulb 19, the two copper wires 25 and the positioning bead 24 are connected together first, and then a fuse 28 is mounted on the tail ends of the two copper wires 25 before being put in he glass tube 21 and being welded in place to form into a round sealed port 22 at one end thereof; the other end thereof is closed into a tapered sealed port 23 or other suitable shape. After the protective bulb 19 and the connector 16 are assembled together, the connector can be plugged in any one of the sockets 15. In case of the tungsten filament 27 of any bulb 17 in the lamp string 13 being burned out, the resistance of the lamp string 13 will be reduced to cause every bulb 17 to have higher power dissipation. The protective bulb 19 plugged in the lamp string 13 can also sense the increased power dissipation of every socket 15; the fuse 28 of the protective bulb 19 is pre-designed with a given figure of power dissipation; in case of the tungsten filaments 27 of a given number of bulbs 17 in the lamp string 13 being burned out, and reaching a given pre-determined number (such as over three bulbs 17 being burned out), the fuse 28 of the protective bulb 19 would be burned out, and the lamp string 13 will have an open circuit so as to prevent from damaging the socket 15 because of a single bulb 17 to have a high temperature, i.e., to overcome the problem of a bulb of the lamp string to be over-heated.

What is claimed is:

1. A safety lamp string comprising:

a) an electrical plug;

b) a first power supply wire extending from the plug;

c) a plurality of lamp sockets connected in series to the first power supply wire including a first lamp socket and a last lamp socket, the first lamp socket being located closest to the electrical plug of the plurality of lamp sockets;

d) a second power supply wire extending directly between the electrical plug and the last lamp socket;

e) a single protective bulb socket connected solely to the first power supply wire between the electrical plug and the first lamp socket; and, f) a protective bulb located in the protective bulb socket and comprising: two wires having ends located within the protective bulb with a glass bead maintaining the two wires spaced apart from each other; and a fuse connected between the ends of the spaced apart wires, whereby the fuse protects against overloading and over heating of bulbs located in the plurality of lamp sockets.

* * * * *